US008650825B2

(12) United States Patent
Minamikawa

(10) Patent No.: US 8,650,825 B2
(45) Date of Patent: Feb. 18, 2014

(54) FURRING STRIP FASTENING MEMBER AND CONSTRUCTION STRUCTURE USING THE SAME

(75) Inventor: Masaya Minamikawa, Nagoya (JP)

(73) Assignee: Nichiha Corporation, Nagoya-Shi (JP)

( * ) Notice: Subject to any disclaimer, the term of this patent is extended or adjusted under 35 U.S.C. 154(b) by 263 days.

(21) Appl. No.: 13/184,242

(22) Filed: Jul. 15, 2011

(65) Prior Publication Data

US 2012/0117914 A1 May 17, 2012

(30) Foreign Application Priority Data

Nov. 17, 2010 (JP) ..... 2010-256466

(51) Int. Cl.
*E04B 2/00* (2006.01)

(52) U.S. Cl.
USPC ..... 52/506.01

(58) Field of Classification Search
USPC ..... 52/167.1, 506.01, 506.06, 506.9, 506.1, 52/512
See application file for complete search history.

(56) References Cited

U.S. PATENT DOCUMENTS 4,040,228 A * 8/1977 Skubic ..... 52/710
5,718,095 A * 2/1998 Kemeny ..... 52/698
5,907,932 A * 6/1999 LeConte et al. ..... 52/144
7,467,687 B2 * 12/2008 Mitchell et al. ..... 181/200
2004/0216398 A1 * 11/2004 Manos et al. ..... 52/167.1
2013/0025235 A1 * 1/2013 Minamikawa ..... 52/705

FOREIGN PATENT DOCUMENTS

JP 2006-090045 A 4/2006
JP 2006090045 A * 4/2006

* cited by examiner

*Primary Examiner* — Brian Glessner
*Assistant Examiner* — Paola Agudelo
(74) *Attorney, Agent, or Firm* — Birch, Stewart, Kolasch & Birch, LLP

(57) ABSTRACT

A furring strip fastening member is formed by a furring strip receiving plate, a bolt hole portion, a spring portion, and a rear face plate. The furring strip receiving plate and the rear face plate are shaped as flat plates that face each other. The bolt hole portion is provided at a central portion of the furring strip receiving plate. The spring portion connects the furring strip receiving plate and the rear face plate. The rear face plate has in a central portion thereof a through-hole. In a construction structure for buildings, a bolt is mounted to an anchor that is driven into a skeleton wall of a building that is formed by a concrete wall and a heat insulating material disposed outside the latter. This bolt traverses a through-hole in the rear face plate, and the bolt is screwed into a bolt hole portion. The furring strip is connected to the furring strip fastening member, and an external wall material is fastened to the furring strip. With the furring strip fastening member, the furring strip receiving plate presses against the furring strip while the rear face plate presses against the heat insulating material, on account of the reaction of the spring portion.

12 Claims, 8 Drawing Sheets

FURRING STRIP FASTENING MEMBER AND CONSTRUCTION STRUCTURE USING THE SAME

BACKGROUND OF THE INVENTION

1. Field of the Invention

The present invention relates to a furring strip fastening member that is used for fastening a furring strip to the skeleton wall of a building made of concrete, for instance reinforced concrete, pre-cast concrete, lightweight aerated concrete or the like, leaving a given spacing between the furring strip and the skeleton wall, and relates to a construction structure that uses the furring strip fastening member.

2. Description of the Related Art

In conventional techniques, heat insulating materials are affixed to the exterior of skeleton walls in buildings made of concrete, an air layer is provided outward of the heat insulating material, and then external wall material is attached, with the air layer interposed therebetween. For instance, Japanese Patent Application Publication No. 2006-90045 discloses an exterior finishing material fastening fixture comprising a channel that is supported by a bolt to which there is mounted a reinforcing member having a female thread section and a fixing section, and by a bolt fixed to a concrete outer wall. The reinforcing member can be screwed, byway of the female thread section thereof, to a male thread section of the bolt, and the fixing section can be fixed to the concrete outer wall.

In order to fix the heat insulating material to a concrete wall in the exterior finishing material fastening fixture set forth in Japanese Patent Application Publication No. 2006-90045, however, a heat insulating material must be fixed by way of a heat insulating material fixing plate, which is troublesome. Also, the heat insulating material fixing plate may loosen over time, or on account of earthquakes or the like. Fixing of the heat insulating material may become insufficient as a result.

SUMMARY OF THE INVENTION

It is an object of the present invention to provide a furring strip fastening member, and a construction structure that uses the furring strip fastening member, in which a heat insulating material can be fixed over long periods of time, byway of a simple structure.

The present invention provides a furring strip fastening member and a construction structure for buildings that uses the furring strip fastening member.

The furring strip fastening member is a furring strip fastening member used for fastening a furring strip to the skeleton wall of a building, with a given spacing being provided between the furring strip and the skeleton wall, and comprises a furring strip receiving plate, a bolt hole portion, a spring portion and a rear face plate. The furring strip receiving plate and the rear face plate are shaped as flat plates that face each other. The bolt hole portion is provided at a central portion of the furring strip receiving plate. The spring portion connects the furring strip receiving plate and the rear face plate. The rear face plate has in a central portion thereof a through-hole. By virtue of the above features, the furring strip fastening member of the present invention can be fixed to the structure skeleton of a building by way of a bolt, and the furring strip receiving plate can presses against the furring strip and the rear faceplate can press against the heat insulating material, over long periods of time, on account of the reaction of the spring portion.

Preferably, the bolt hole portion of the furring strip fastening member of the present invention has a thread onto which there is screwed the bolt, since loosening of the bolt is suppressed thereby.

Preferably, the furring strip receiving plate has, at the outer edge, a flange that is bent towards the rear face plate, since in that case the outer edge has high strength.

Preferably, the furring strip receiving plate and the rear face plate have a hook that is fixed through crimping of the spring portion, since in that case the furring strip receiving plate, the rear face plate and the spring portion constitute a single whole, which facilitates work.

Preferably, the rear face plate is substantially circular, since in that case the position of the furring strip receiving plate can be easily adjusted, by rotating the rear face plate while the latter is pressed against the heat insulating material, during affixing of the furring strip fastening member. The substantially circular shape may be circular or may be a polygon having five or more angles.

The present invention provides also a construction structure for buildings in which a furring strip is fastened to a skeleton wall of a building using the above-described furring strip fastening member. In the construction structure for buildings of the present invention, the skeleton wall of the building is formed by a concrete wall and a heat insulating material disposed outside the concrete wall; an anchor is driven into the skeleton wall of the building; a bolt is mounted to the anchor; the furring strip fastening member is connected in a state where the bolt traverses a through-hole in a rear face plate and the bolt is screwed into a bolt hole portion; a furring strip is connected to a furring strip fastening member; and an external wall material is fastened to the furring strip. With the furring strip fastening member, the furring strip receiving plate presses against the furring strip while the rear face plate presses against the heat insulating material, on account of the reaction of the spring portion.

In the construction structure in a building of the present invention, preferably, the position of the furring strip is adjusted on the basis of the degree of screwing the bolt into the bolt hole portion of the furring strip fastening member, since in that case no unevenness occurs upon affixing of the external wall material.

The present invention succeeds thus in providing a furring strip fastening member, and a construction structure that uses the furring strip fastening member, in which a heat insulating material can be fixed over long periods of time, by way of a simple structure.

DESCRIPTION OF THE PREFERRED EMBODIMENTS

An explanation follows next on an embodiment of the furring strip fastening member of the present invention and an embodiment of a construction structure that uses the furring strip fastening member.

Figure 1:
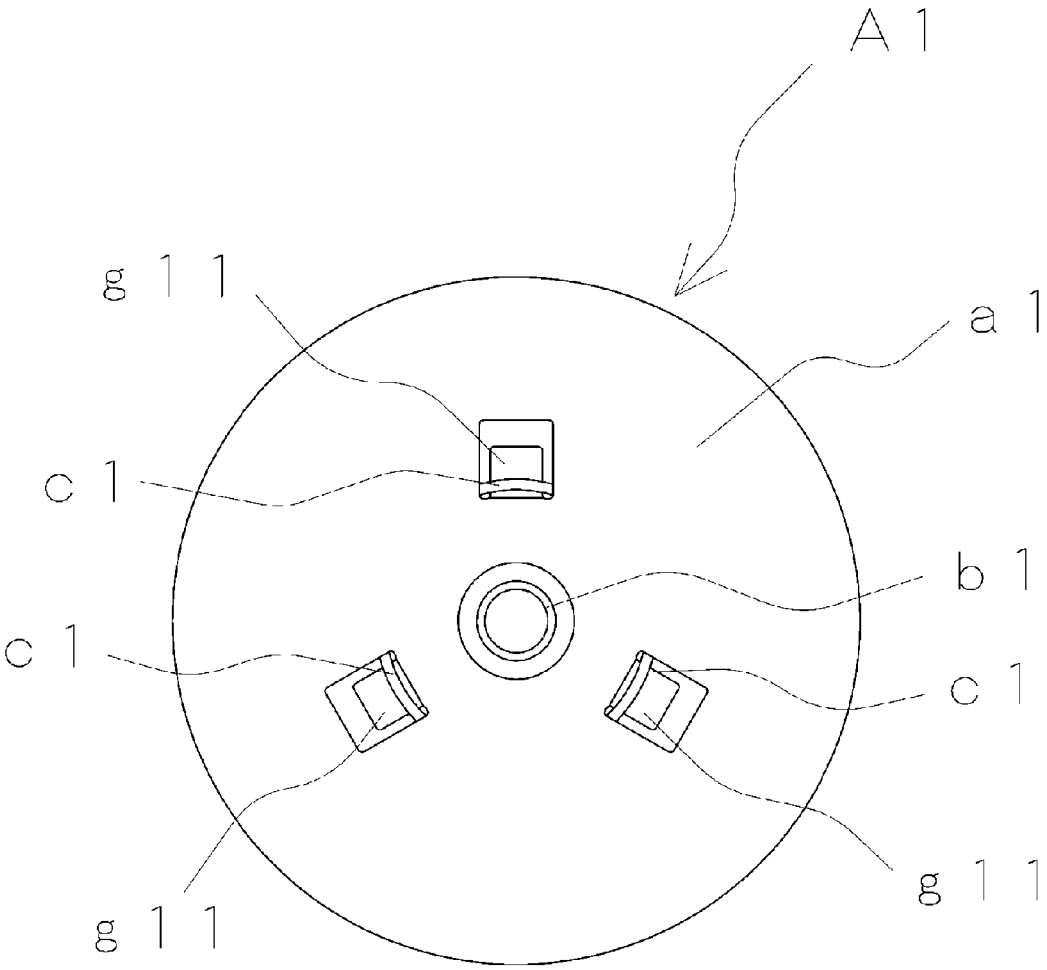
FIG. 1 is a front-view diagram of one embodiment of a furring strip fastening member according to the present invention.
Figure 2:
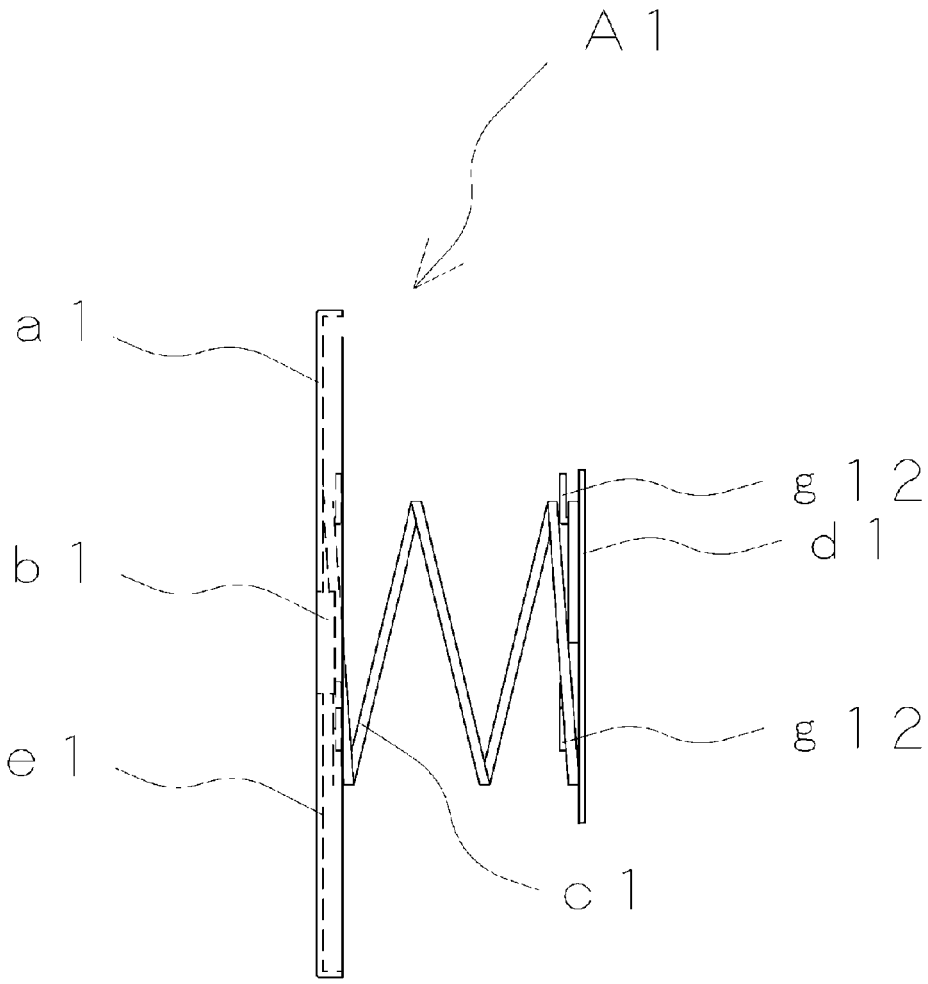
FIG. 2 is a right side-view diagram of the furring strip fastening member illustrated in FIG. 1.
Figure 3:
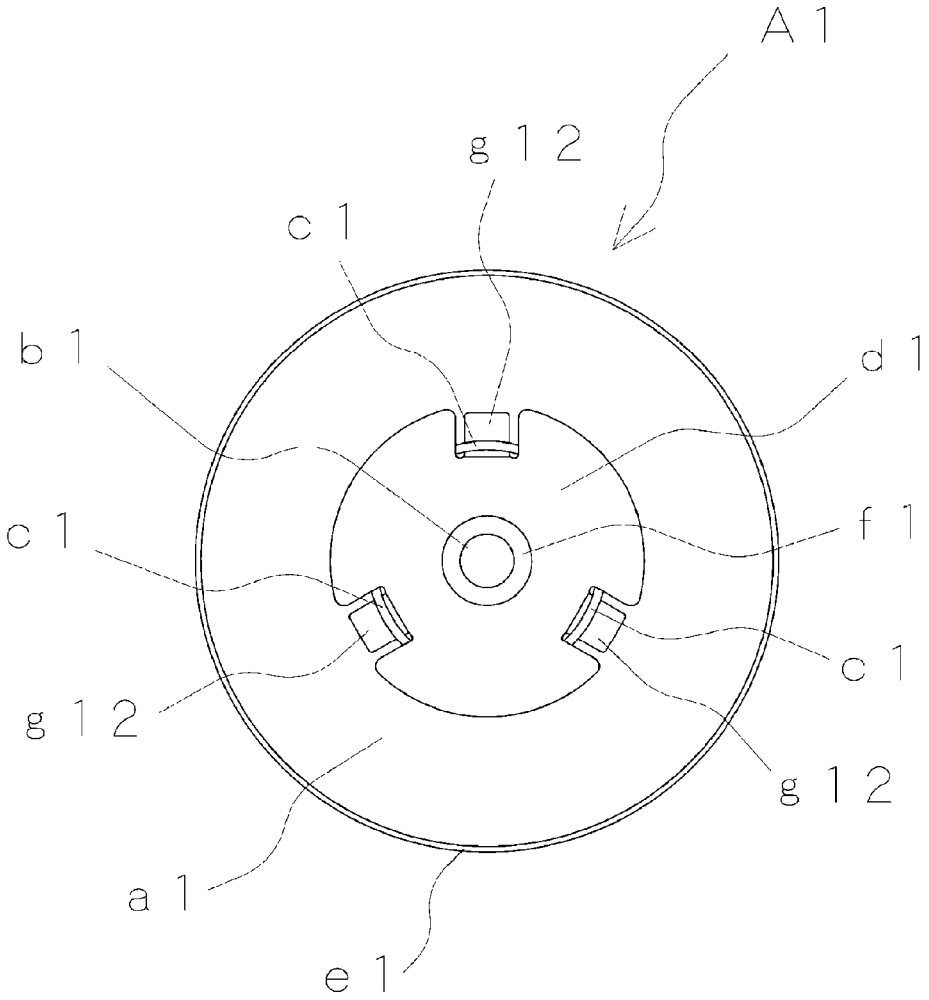
FIG. 3 is a rear-view diagram of the furring strip fastening member illustrated in FIG. 1.

FIGS. 1, 2 and 3 are, respectively, a front-view diagram, a right side-view diagram and a rear-view diagram of an embodiment of a furring strip fastening member according to the present invention. A furring strip fastening member A1 comprises a furring strip receiving plate a1, a bolt hole portion b1, spring portions c1 and a rear face plate d1. The furring strip receiving plate a1 and the rear face plate d1 are shaped as flat plates that are mutually opposing. The bolt hole portion b1, which is provided at a central portion of the furring strip receiving plate a1, protrudes towards the rear face plate d1 and has a thread onto which bolt is screwed. The spring portions c1 have a coiled spring shape. The furring strip receiving plate a1 and the rear face plate d1 have hooks g11, g12 that are fixed through crimping of the spring portions c1. The spring portions c1 are crimped at the hooks g11, g12, and hence the furring strip receiving plate a1 and the rear face plate d1 are in a state of being connected by way of the spring portions c1. The bolt hole portion b1 is provided so as to be positioned within the inner diameter of the spring portions c1. The furring strip receiving plate a1 has, at the outer edge, a circular flange e1 that is bent towards the rear face plate d1. The furring strip receiving plate a1 has high strength as a result. The rear face plate d1 is circular in shape and has, in the central portion thereof, a through-hole f1 of a size that enables a bolt to run therethrough. As illustrated in FIG. 3, the bolt hole portion b1 and the through-hole f1 are disposed in a straight line such that the bolt hole portion b1 can be viewed through the through-hole f1. Therefore, a bolt can run through the bolt hole portion b1 and the through-hole f1.

Figure 4:
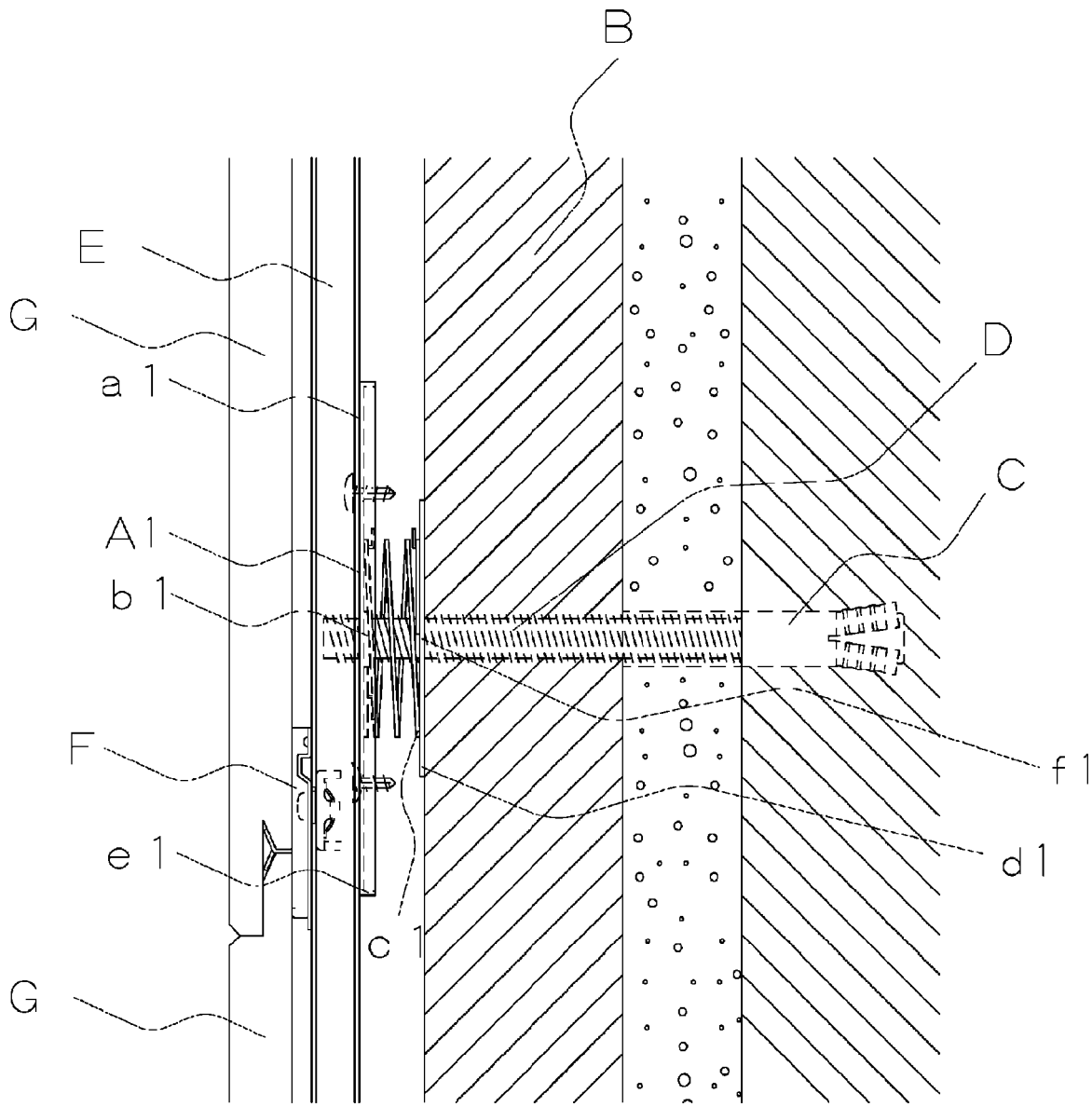
FIG. 4 is a vertical cross-sectional diagram illustrating the furring strip fastening member shown in FIG. 1, in an affixed state.
Figure 5:
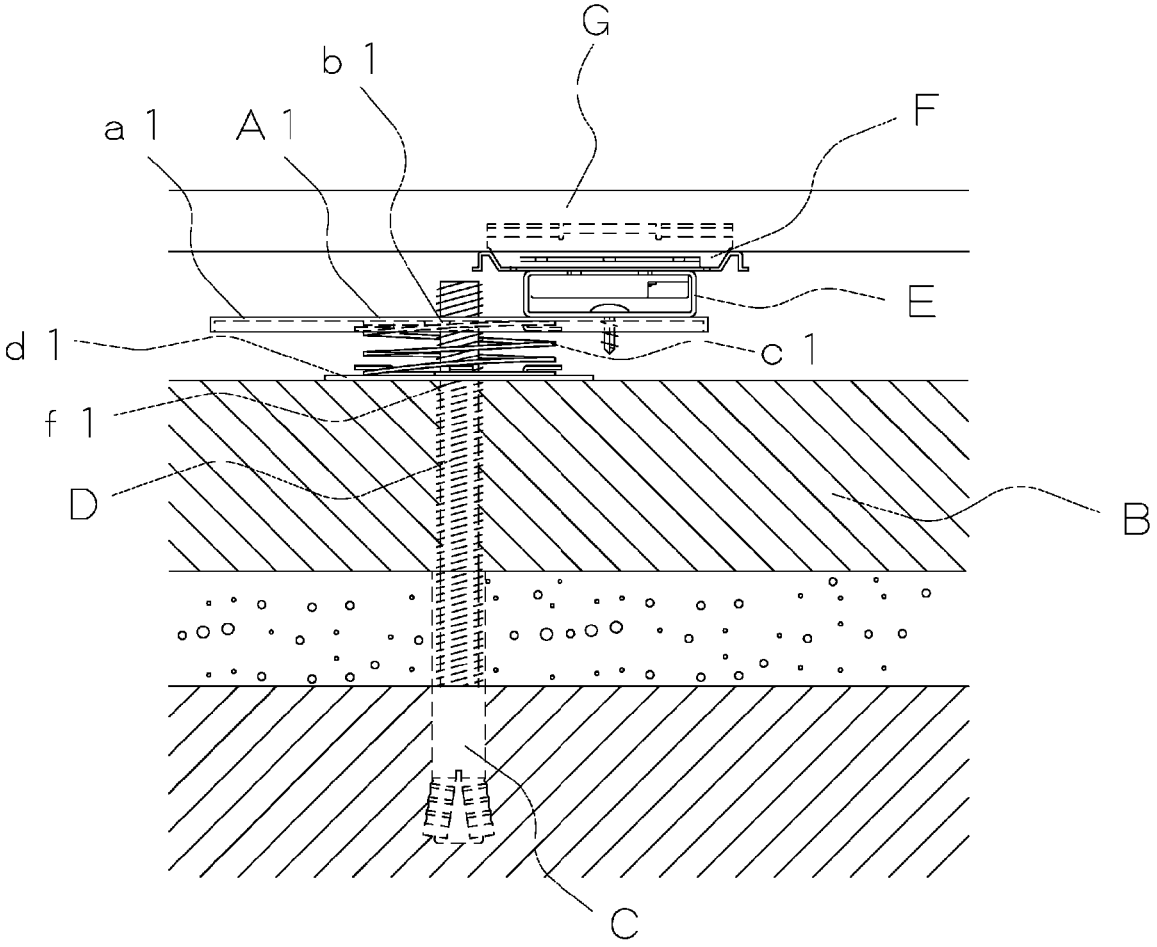
FIG. 5 is a horizontal cross-sectional diagram illustrating the furring strip fastening member shown in FIG. 1, in an affixed state.

FIG. 4 is a vertical cross-sectional diagram of the furring strip fastening member A1 illustrated in FIG. 1, in an affixed state. FIG. 5 is a horizontal cross-sectional diagram thereof. The skeleton wall of the building comprises a concrete wall and a heat insulating material B disposed outside the concrete wall. An anchor C is driven into the skeleton wall of the building, and a bolt D is mounted to the anchor C. The furring strip fastening member A1 is fixed in a state where the bolt D traverses the through-hole f1 of the rear face plate d1 and is screwed onto the bolt hole portion b1. A furring strip E is in surface-contact with the furring strip receiving plate a1 of the furring strip fastening member A1, and is fixed to the furring strip receiving plate a1 by way of screws. An external wall material fastening fixture F is fixed to the furring strip E, and an external wall material G is fastened by the external wall material fastening fixture F, to make up thereby the outer wall of the building. The furring strip fastening member A1 of the construction structure illustrated in FIG. 4 comprises the furring strip receiving plate a1, the bolt hole portion b1, the spring portions c1 and the rear face plate d1, and has therefore a very simple structure. In the construction structure of FIG. 4, the furring strip receiving plate a1 of the furring strip fastening member A1 presses against the furring strip E, and the rear face plate d1 presses against the heat insulating material B on account of the reaction of the spring portions c1. Therefore, the furring strip fastening member A1 does not loosen readily over the years, or on account of earthquakes or the like, and thus the heat insulating material B can be reliably fixed over long periods of time. In the construction structure of FIG. 4, moreover, the position of the furring strip E is adjusted on the basis of the degree of screwing of the bolt D and the bolt hole portion b1 of the furring strip fastening member A1. Therefore, the external wall material G exhibits no unevenness. In the construction structure of FIG. 4, the rear face plate d1 of the furring strip fastening member A1 is circular in shape, and hence the rear face plate d1 can easily rotate while pressed against the heat insulating material B during affixing, which is made thus easier. The furring strip receiving plate a1 and the rear face plate d1 have hooks g11, g12 fixed through crimping of the spring portions c1. The spring portions c1 are thus crimped on the hooks g11, g12, and hence the furring strip receiving plate a1, the rear face plate d1 and the spring portions c1 can be readily affixed as a single whole, which facilitates affixing.

Figure 6:
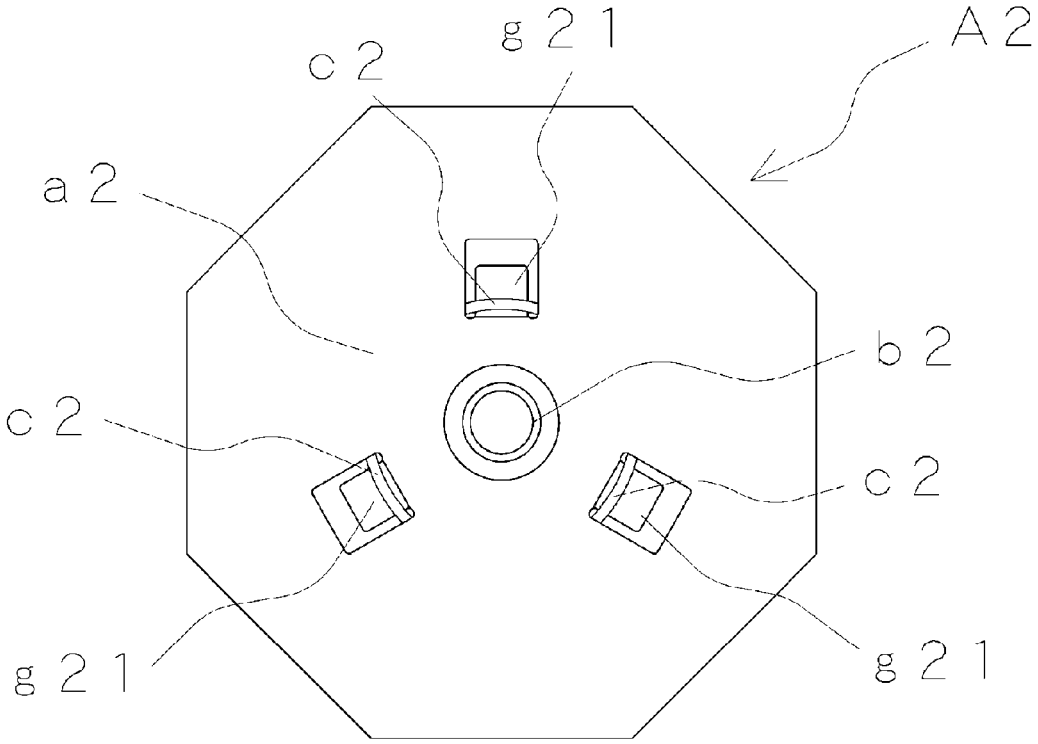
FIG. 6 is a front-view diagram of another embodiment of a furring strip fastening member according to the present invention.
Figure 7:
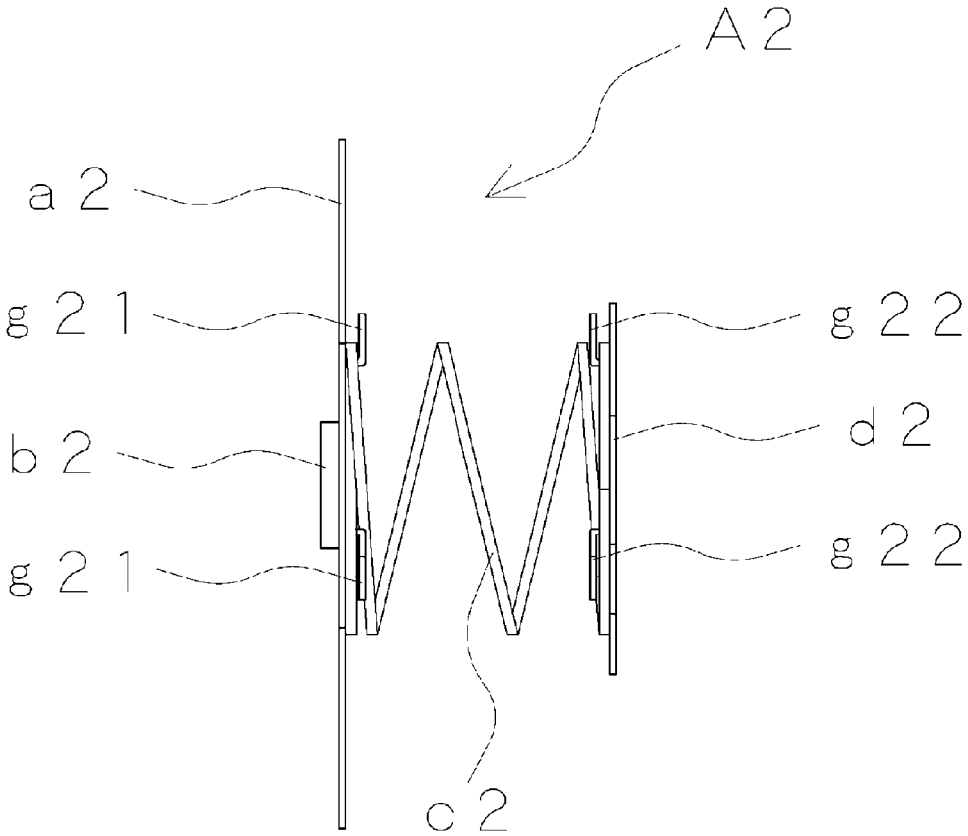
FIG. 7 is a right side-view diagram of the furring strip fastening member illustrated in FIG. 6.
Figure 8:
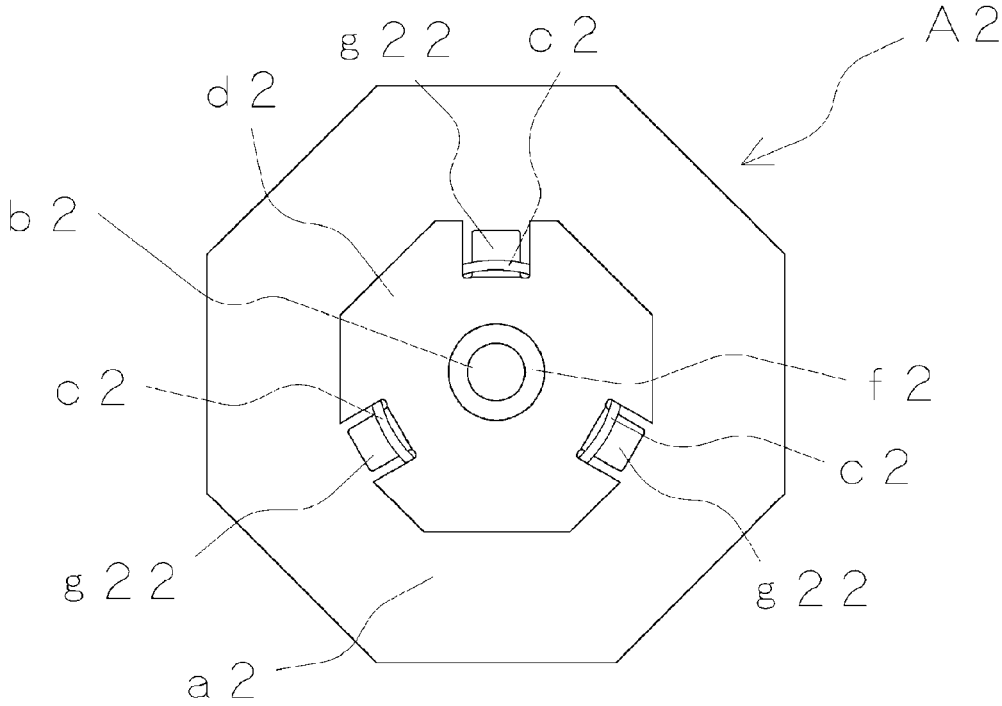
FIG. 8 is a rear-view diagram of the furring strip fastening member illustrated in FIG. 6.

FIGS. 6, 7 and 8 are, respectively, a front-view diagram, a right side-view diagram and a rear-view diagram illustrating another embodiment of the furring strip fastening member according to the present invention. A furring strip fastening member A2 has a furring strip receiving plate a2, a bolt hole portion b2, spring portions c2 and a rear face plate d2. The furring strip receiving plate a2 and the rear face plate d2 have hooks g21, g22 fixed through crimping of the spring portions c2. The rear face plate d2 has a through-hole f2. The furring strip fastening member A2 differs from the furring strip fastening member A1 in that now the furring strip receiving plate a2 is octagonal and has no flange, the bolt hole portion b2 protrudes towards a side opposite to the side of the rear face plate d2, and the rear face plate d2 is octagonal, other features being identical. Accordingly, the furring strip fastening member A2 has a very simple structure. The construction structure illustrated in FIGS. 4 and 5 can be implemented using also the furring strip fastening member A2, in the same way as in the case of the furring strip fastening member A1. In the construction structure that uses the furring strip fastening member A2, the furring strip receiving plate a2 presses against the furring strip E, and the rear face plate d2 presses against the heat insulating material B, on account of the reaction of the spring portions c2 of the furring strip fastening member A2. Therefore, the furring strip fastening member A2 does not loosen readily over the years, or on account of earthquakes or the like, and thus the heat insulating material B can be reliably fixed over long periods of time. Moreover, the position of the furring strip E is adjusted on the basis of the degree of screwing of the bolt D and the bolt hole portion b2 of the furring strip fastening member A2. Therefore, the external wall material G exhibits no unevenness. The furring strip receiving plate a2 and the rear face plate d2 have hooks g21, g22 fixed through crimping of the spring portions c2. The spring portions c2 are thus crimped on the hooks g21, g22, and hence the furring strip receiving plate a2, the rear face plate d2 and the spring portions c2 can be readily affixed as a single whole, which facilitates affixing.

Embodiments of the present invention have been explained above, but the present invention is not limited thereto, and can be embodied in various manners without departing from the scope of the invention as defined in the appended claims. For instance, the spring portions in the furring strip fastening member may be shaped as disk springs. The bolt hole portion may be shaped as a nut.

As described above, the present invention succeeds in providing a furring strip fastening member, and a construction structure that uses the furring strip fastening member, in which a heat insulating material can be fixed over long periods of time, by way of a simple structure.

What is claimed is:

1. A furring strip fastening member used for fastening a furring strip to a skeleton wall of a building, with a given spacing being provided between the furring strip and the skeleton wall, the furring strip fastening member comprising:

a furring strip receiving plate having a bolt hole at a central portion of the furring strip receiving plate;

a spring; and a rear face plate having in a central portion a through-hole, wherein the furring strip receiving plate and the rear face plate are shaped as flat plates that face each other, the spring connects the furring strip receiving plate and the rear face plate, and each of the furring strip receiving plate and the rear face plate comprises a hook to which the spring is fixed through by crimping of the hook.

2. The furring strip fastening member according to claim 1, wherein the bolt hole has a thread onto which a bolt is screwed.

3. The furring strip fastening member according to claim 2, wherein the furring strip receiving plate has, at an outer edge thereof, a flange that is bent towards the rear face plate.

4. A construction structure for a building, in which a furring strip is fastened to a skeleton wall of a building using the furring strip fastening member according to claim 2, wherein the skeleton wall of the building is formed by a concrete wall and a heat insulating material is disposed outside the concrete wall, an anchor is driven into the skeleton wall of the building, the bolt is mounted to the anchor, the furring strip fastening member is connected in a state where the bolt traverses a through-hole in the rear face plate and the bolt is screwed into the bolt hole, the furring strip is connected to the furring strip fastening member, and an external wall material is fastened to the furring strip, with the furring strip fastening member, the furring strip receiving plate presses against the furring strip while the rear face plate presses against the heat insulating material, due to reaction of the spring.

5. The construction structure for a building according to claim 4, wherein the position of the furring strip is adjusted on the basis of the degree of screwing of the bolt into the bolt hole of the furring strip fastening member.

6. The furring strip fastening member according to claim 1, wherein the furring strip receiving plate has, at an outer edge thereof, a flange that is bent towards the rear face plate.

7. A construction structure for a building, in which a furring strip is fastened to a skeleton wall of a building using the furring strip fastening member according to claim 6, wherein the skeleton wall of the building is formed by a concrete wall and a heat insulating material is disposed outside the concrete wall, an anchor is driven into the skeleton wall of the building, a bolt is mounted to the anchor, the furring strip fastening member is connected in a state where the bolt traverses a through-hole in the rear face plate and the bolt is screwed into the bolt hole, the furring strip is connected to the furring strip fastening member, and an external wall material is fastened to the furring strip, with the furring strip fastening member, the furring strip receiving plate presses against the furring strip while the rear face plate presses against the heat insulating material, due to reaction of the spring.

8. The construction structure for a building according to claim 7, wherein the position of the furring strip is adjusted on the basis of the degree of screwing of the bolt into the bolt hole of the furring strip fastening member.

9. The furring strip fastening member according to claim 1, wherein the rear face plate is substantially circular.

10. A construction structure for a building, in which a furring strip is fastened to a skeleton wall of a building using the furring strip fastening member according to claim 9, wherein the skeleton wall of the building is formed by a concrete wall and a heat insulating material is disposed outside the concrete wall, an anchor is driven into the skeleton wall of the building, a bolt is mounted to the anchor, the furring strip fastening member is connected in a state where the bolt traverses a through-hole in the rear face plate and the bolt is screwed into the bolt hole, the furring strip is connected to the furring strip fastening member, and an external wall material is fastened to the furring strip, with the furring strip fastening member, the furring strip receiving plate presses against the furring strip while the rear face plate presses against the heat insulating material, due to reaction of the spring.

11. A construction structure for a building, in which a furring strip is fastened to a skeleton wall of a building using the furring strip fastening member according to claim 1, wherein the skeleton wall of the building is formed by a concrete wall and a heat insulating material is disposed outside the concrete wall, an anchor is driven into the skeleton wall of the building, a bolt is mounted to the anchor, the furring strip fastening member is connected in a state where the bolt traverses a through-hole in the rear face plate and the bolt is screwed into the bolt hole, the furring strip is connected to the furring strip fastening member, and an external wall material is fastened to the furring strip, with the furring strip fastening member, the furring strip receiving plate presses against the furring strip while the rear face plate presses against the heat insulating material, due to reaction of the spring.

12. The construction structure for a building according to claim 11, wherein the position of the furring strip is adjusted on the basis of the degree of screwing of the bolt into the bolt hole of the furring strip fastening member.

* * * * *